US009452460B2

(12) United States Patent
Nojiri et al.

(10) Patent No.: US 9,452,460 B2
(45) Date of Patent: Sep. 27, 2016

(54) HOT-PRESSING DIE AND METHOD FOR MANUFACTURING THE SAME

(75) Inventors: Isao Nojiri, Nisshin (JP); Shinji Ishii, Aichi-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 400 days.

(21) Appl. No.: 14/117,776

(22) PCT Filed: May 16, 2011

(86) PCT No.: PCT/JP2011/061189

§ 371 (c)(1),
(2), (4) Date: Nov. 14, 2013

(87) PCT Pub. No.: WO2012/157064

PCT Pub. Date: Nov. 22, 2012

(65) Prior Publication Data

US 2014/0069163 A1 Mar. 13, 2014

(51) Int. Cl.

| | |
|---|---|
| ***B21D 22/02*** | (2006.01) |
| ***B21J 1/06*** | (2006.01) |
| ***B21D 37/16*** | (2006.01) |
| ***B21D 37/20*** | (2006.01) |
| *C21D 1/673* | (2006.01) |

(52) U.S. Cl.

CPC ..... *B21D 22/022* (2013.01); *B21D 37/16* (2013.01); *B21D 37/20* (2013.01); *B21J 1/06* (2013.01); *C21D 1/673* (2013.01)

(58) Field of Classification Search

CPC ..... B21D 22/022; B21D 37/16; B21J 1/06
USPC ..... 72/342.3, 342.4, 342.5
See application file for complete search history.

(56) References Cited

U.S. PATENT DOCUMENTS

| | | | | |
|---|---|---|---|---|
| 6,742,374 | B2 * | 6/2004 | Ozawa | B21J 1/06 72/342.4 |
| 8,555,691 | B2 * | 10/2013 | Kurisu | B21D 22/022 72/342.3 |
| 2002/0113041 | A1 | 8/2002 | Ozawa | |
| 2014/0130564 | A1 * | 5/2014 | Suzuki | B21J 1/06 72/342.5 |
| 2014/0137619 | A1 * | 5/2014 | Asano | B21D 22/208 72/38 |
| 2014/0190233 | A1 * | 7/2014 | Ishii | B21D 22/208 72/342.2 |
| 2014/0305181 | A1 * | 10/2014 | Kobayashi | B21D 37/16 72/342.5 |

FOREIGN PATENT DOCUMENTS

| | | | |
|---|---|---|---|
| CN | 201316764 Y | | 9/2009 |
| JP | A-2003-241810 | | 8/2003 |
| JP | A-2006-326620 | | 12/2006 |
| JP | A-2010-207910 | | 9/2010 |
| JP | 2013/005318 | * | 1/2013 |
| WO | WO 2010/076247 A1 | | 7/2010 |
| WO | 2013/005318 | * | 10/2013 |

* cited by examiner

*Primary Examiner* — David B Jones
(74) *Attorney, Agent, or Firm* — Oliff PLC

(57) ABSTRACT

A hot-pressing die and a method for manufacturing the hot-pressing die are disclosed. The die which presses and cools a heated workpiece at the same time to form a product with a hat-shape includes a lower die and an upper die. The lower die has a protrusion which protrudes from the forming surface thereof, and the upper die has a recess corresponding to the protrusion. The lower die is modified into a modified lower die by forming, on the forming surface of the protruding end of the protrusion, a buildup part with a convex shape to gradually change in position in the protruding direction of the protrusion toward the middle thereof.

2 Claims, 7 Drawing Sheets

HOT-PRESSING DIE AND METHOD FOR MANUFACTURING THE SAME

TECHNICAL FIELD

The present invention relates to a die used in hot-press forming in which a heated workpiece is pressed and cooled at the same time, and to a method for manufacturing the die used in the hot-press forming.

BACKGROUND ART

Conventionally, hot-press forming is widely known in which a pressing machine to which a die consisting of an upper die and a lower die is fixed presses a workpiece, such as a steel plate, heated to above a temperature at which an austenite structure appears, and at the same time, quenches the workpiece utilizing cooling by contact between the die and the workpiece.

A technique for the hot-press forming is publicly known which enables the die to suitably cool the workpiece during the quenching by providing water channels through which cooling water to cool the die flows in the die (for example, see Patent Literature 1).

However, since the pressed workpiece slightly deforms because of wrinkles thereof, spring back and the like, a gap is formed between the workpiece and the die when the die is closed. Consequently, a contact area between the surface of the workpiece and the forming surface of the die decreases during the quenching, which causes a problem that hardness of some parts in the workpiece is smaller than a predetermined value because of an insufficient cooling rate.

With reference to FIG. 7, described below is a problem occurring when a pressing machine (not shown) to which as die 100 as a conventional hot-pressing die is fixed performs the hot-press forming of a workpiece W formed in a flat plate to produce a product P.

For convenience, a top-bottom direction in FIG. 7 is defined as a top-bottom direction of the die 100, and a right-left direction in FIG. 7 is defined as a right-left direction of the die 100. In addition, this side in FIG. 7 is defined as a front side of the die 100, and the far side in FIG. 7 is defined as a rear side of the die 100, thereby a front-rear direction of the die 100 being defined.

As shown in FIG. 7, the die 100 includes a lower die 101 and an upper die 102 which are arranged so that the forming surfaces thereof are opposed to each other.

The lower die 101 has a protrusion 101*a* which protrudes upward from the intermediate part (the substantially middle part) of the forming surface thereof in the right-left direction.

The upper die 102 has a recess 102*a* in which the intermediate part (the substantially middle part), in the right-left direction, of the forming surface thereof dents upward along the shape of the protrusion 101*a*.

The lower die 101 and the upper die 102 are arranged so that the forming surfaces thereof are opposed to each other. The upper die 102 approaches the lower die 101 to move to the bottom dead center, and thereby the lower die 101 and the upper die 102 perform the hot-press forming of the workpiece W arranged therebetween to produce the product P.

The product P has a shape in which what is called a hat-shaped section taken along the forming surfaces of the lower die 101 and the upper the 102 continues in the front-rear direction. The longitudinal direction of the product P corresponds to the front-rear direction.

Specifically, the product P has a top part P1 extending in the right-left direction in the uppermost part of the product P, two lateral parts P2 extending downward from both the ends of the top part P1 in the right-left direction, and two flanges P3 extending outward in the right-left direction from the bottom ends of the lateral parts P2.

In the product P with the above-mentioned shape, the top part P1 comes out of proximity with the protrusion 101*a* of the lower die 101 after the press working because of spring back and the like, and thereby a gap is formed between the product P and the die 100. Consequently, some parts in the product P are cooled at an insufficient cooling rate during the quenching. In particular, the substantially middle part of the top part P1 in the right-left direction has such a tendency, and the hardness thereof may be insufficient.

Pressing the workpiece at a relatively high pressure can solve the above-mentioned problem. However, it is disadvantageous in that an increase in size of the press machine for performing the hot-press forming leads to an increase in cost and the like.

CITATION LIST

Patent Literature

Patent Literature 1: JP 2006-326620 A

SUMMARY OF INVENTION

Problem to be Solved by the Invention

The objective of the present invention is to provide a hot-pressing die capable of quenching a workpiece at a sufficient cooling rate without increasing a pressure at which the workpiece is pressed, and a method for manufacturing the hot-pressing die.

Means for Solving the Problem

A first aspect of the present invention is a hot-pressing die which presses and cools a heated workpiece at the same time to form a product having a shape in which a hat-shaped section continues in a front-rear direction. The hot-pressing die includes a lower die having a lower forming surface, and an upper die having an upper forming surface facing the lower forming surface. One of the lower die and the upper die has a protrusion formed on the forming surface of said one to protrude toward the other, the protrusion being formed in an intermediate pan, in a right-left direction perpendicular to the front-rear direction, of the forming surface of said one. The other of the lower die and the upper die has a recess formed on the forming surface of the other, the recess corresponding to the protrusion. The protrusion has a section formed at a protruding end thereof, the section being modified to form a convex to gradually change in position in a protruding direction of the protrusion toward the middle of the section in the right-left direction.

A second aspect of the present invention is a method for manufacturing a hot-pressing die which presses and cools a heated workpiece at the same time to form as product. The method includes a first step for measuring as three-dimensional shape of a forming surface of the hot-pressing die, and a three-dimensional shape of a surface of the product thrilled by the hot-pressing die, a second step for calculating, based on the three-dimensional shape of the hot-pressing die and the three-dimensional shape of the surface of the product measured in the first step, a three-dimensional shape of a gap between the forming surface of the hot-pressing die and the surface of the product when the hot-pressing die is closed after the press working, and a third step for modifying, based on the three-dimensional shape of the gap calculated in the second step, the thrilling surface of the hot-pressing die so as to fill the gap.

Effects of the Invention

The present invention makes it possible to quench a workpiece at a sufficient cooling rate without increasing a pressure at which the workpiece is pressed, and to prevent hardness of some parts in the workpiece from being smaller than a predetermined value.

DESCRIPTION OF EMBODIMENTS

Figure 1:
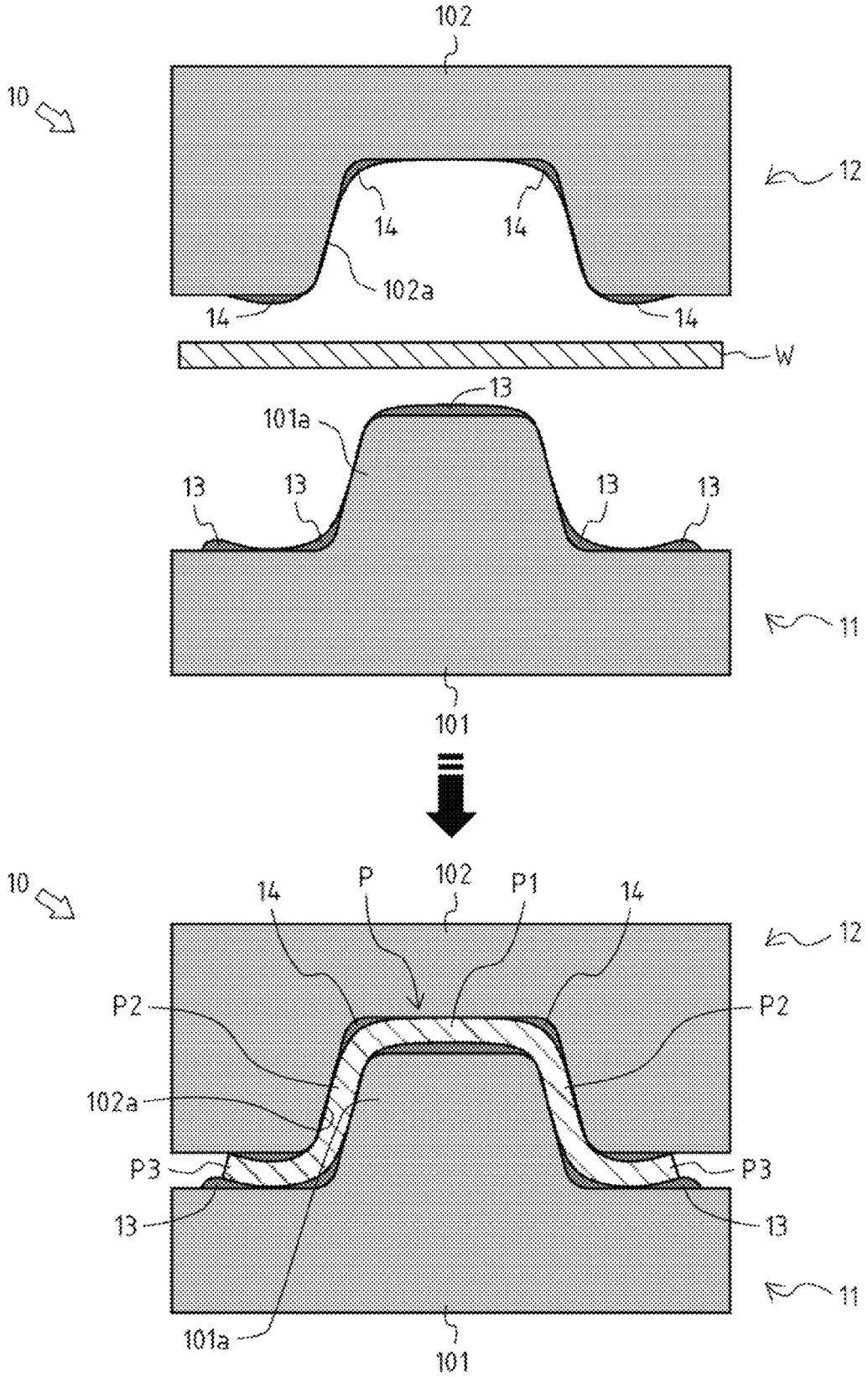
FIG. 1 illustrates as hot-pressing die according to an embodiment of the present invention.

With reference to FIG. 1, described below is a die 10 as an embodiment of a hot-pressing die according to the present invention.

The die 10 is a hot-pressing die. The die 10 is fixed to a predetermined pressing machine (not shown), and performs hot-press forming of a workpiece W to produce a product P.

For convenience, a top-bottom direction in FIG. 1 is defined as a top-bottom direction of the die 10, and a right-left direction in FIG. 1 is defined as a right-left direction of the die 10. In addition, this side in FIG. 1 is defined as a front side of the die 10, and the far side in FIG. 1 is defined as a rear side of the die 10, thereby a front-rear direction of the die 10 being defined.

The workpiece W is a steel plate to be pressed by the pressing machine to which the die 10 is fixed.

The product P is produced when the pressing machine to which the die 10 is fixed performs the hot-press forming of the workpiece W. The product P has a top part P1 extending in the right-left direction in the uppermost part of the product P, two lateral parts P2 extending downward from both the ends of the top part P1 in the right-left direction, and two flanges P3 extending outward in the right-left direction from the bottom ends of the lateral parts P2. The product P has a shape in which what is called a hat-shaped section continues in the front-rear direction. In the present embodiment, the product P is a semi-finished product of a center pillar outer reinforcement of a car, and is worked into the center pillar outer reinforcement by predetermined trimming or the like.

As shown in FIG. 1, the die 10 includes a modified lower die 11 and a modified upper die 12 which are arranged so that the forming surfaces thereof are opposed to each other.

The modified lower die 11 corresponds to the modified upper die 12. The modified lower die 11 has a lower die 101, and a plurality of buildup parts 13.

Figure 7:
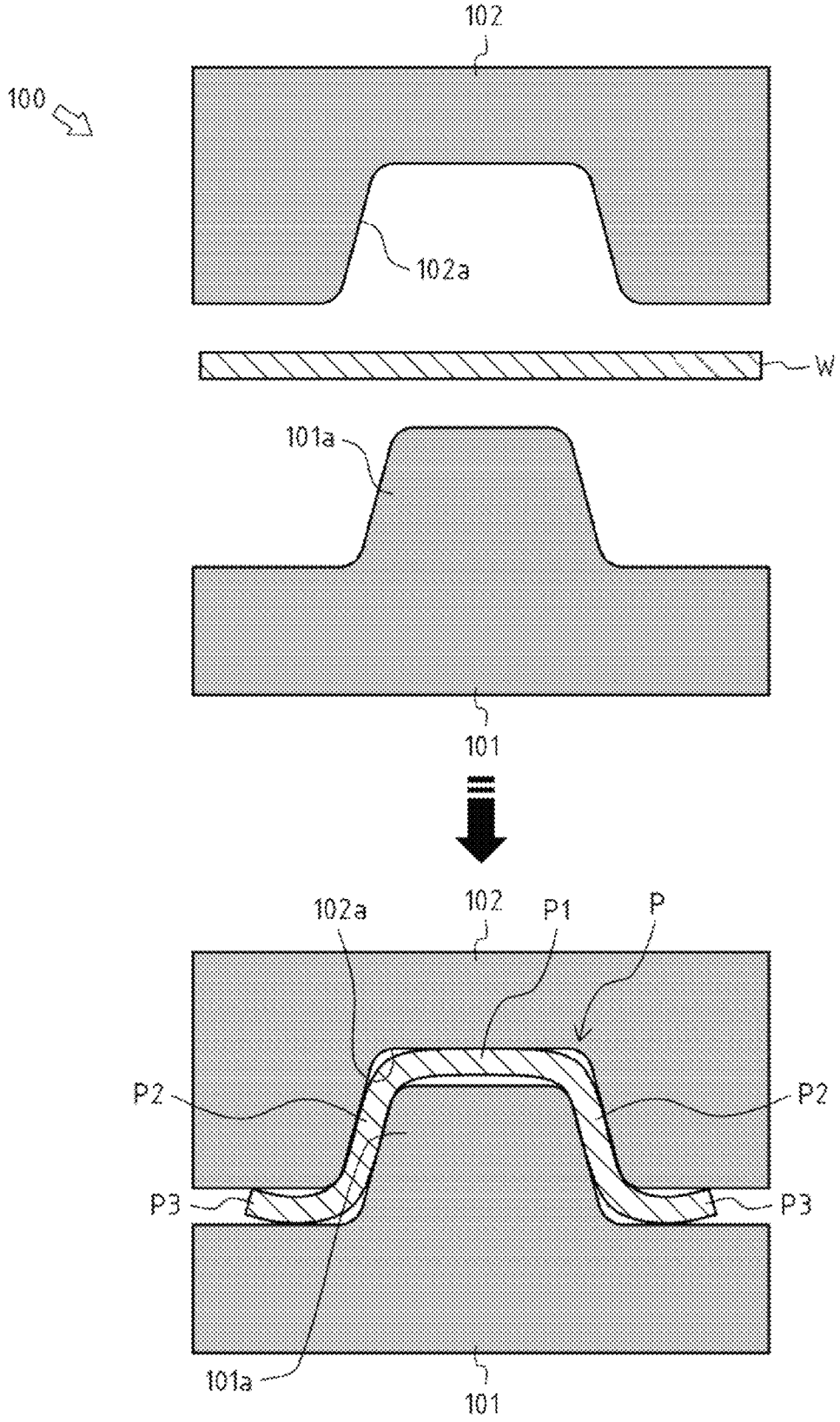
FIG. 7 illustrates a conventional hot-pressing die.

The lower die 101 is a part of a die 100 (see FIG. 7) as a conventional hot-pressing die. The lower die 101 is configured so that cooling water flows thereinside. The lower die 101 has a protrusion 101*a* which protrudes upward from the intermediate part (the substantially middle part) in the right-left direction, of the forming surface (the upper surface) thereof.

The protrusion 101*a* forms, with an after-mentioned recess 102*a*, the top part P1 and the lateral parts P2 of the product P. The protrusion 101*a* continues in the front-rear direction in the intermediate part (the substantially middle part), in the right-left direction, of the forming surface of the lower the 101. The surface of the protrusion 101*a* corresponding to the top part P1 substantially horizontally extends in the right-left direction, and the two surfaces of the protrusion 101*a* corresponding to the lateral parts P2 are inclined to gradually separate from each other toward the bottom ends thereof.

The buildup parts 13 are formed by performing overlay welding of the forming surface of the lower die 101 including the protrusion 101*a*. The buildup parts 13 are formed so as to fill gaps (hereinafter referred to as "lower gaps") between the product P deformed slightly after being pressed because of spring back and the like, and the lower die 101.

The modified upper die 12 corresponds to the modified lower die 11. The modified upper die 12 has an upper die 102, and a plurality of buildup parts 14.

The upper die 102 is a part of the die 100 (see FIG. 7) as a conventional hot-pressing die. The upper die 102 is configured so that the cooling water flows thereinside. The upper die 102 has the recess 102*a* in which the intermediate part (the substantially middle part), in the right-left direction, of the forming surface (the lower surface) thereof dents upward along the shape of the protrusion 101*a*.

The recess 102*a* forms, with the protrusion 101*a*, the top part P1 and the lateral parts P2 of the product P. The recess 102*a* continues in the front-rear direction in the intermediate part (the substantially middle part), in the right-left direction, of the forming surface of the upper die 102. The surface of the recess 102*a* corresponding to the top pan P1 substantially horizontally extends in the right-left direction, and the two surfaces of the recess 102*a* corresponding to the lateral parts P2 are inclined to gradually separate from each other toward the bottom ends thereof.

The buildup parts 14 are formed by performing overlay welding of the forming surface of the upper die 102 including the recess 102*a*. The buildup pans 14 are formed so as to fill gaps (hereinafter referred to as "upper gaps") between the product P deformed slightly after being pressed because of spring back and the like, and the upper die 102.

The modified lower die 11 and the modified upper die 12 are arranged so that the forming surfaces thereof are opposed to each other. The modified upper die 12 approaches the modified lower die 11 to move to the bottom dead center, and thereby the modified lower die 11 and the modified upper die 12 perform the hot-press forming of the workpiece W arranged therebetween to produce the product P.

Specifically, when the modified upper die 12 moves into proximity with the modified lower die 11, the protrusion 101*a* of the lower die 101 and the recess 102*a* of the upper die 102 bend the workpiece W. Thereby, the top part P1 and the lateral parts P2 of the product P are formed, and the parts of the product P except the top part P1 and the lateral parts P2 act as the flanges P3.

At this time, since the plurality of buildup parts 13 and the plurality of buildup parts 14 are formed on the forming surfaces of the lower die 101 and the upper die 102 so as to fill the lower gaps and the upper gaps, a contact area between the product P and the modified lower die 11, and a contact area between the product P and the modified upper die 12 are relatively large when the product P is quenched.

In other words, since the die 10 is configured so that the space between the forming surfaces of the modified lower die 11 and the moth tied upper die 12 positioned at the bottom dead center (between the loaning surfaces of the modified lower die 11 and the modified upper die 12 when the die 10 is closed) coincides in form with the product P deformed slightly after being pressed because of spring back and the like, a contact area between the die 10 and the product P is larger than a contact area between the die 100 as a conventional hot-pressing die and the product P when the product P is quenched.

This makes it possible to quickly remove heat of the product P through a surface of the die 10 being in contact with the product P during the quenching.

Therefore the whole product P can be cooled at a sufficient cooling rate without increasing a pressure at which the workpiece W is pressed, thus enabling to prevent hardness of some parts of the product P from being smaller than as predetermined value.

In the present embodiment, the lower gaps and the upper gaps are entirely filled by forming the plurality of buildup parts 13 and the plurality of buildup parts 14 on the forming surfaces of the lower die 101 and the upper die 102.

However, generally, in the product P having the shape in which the hat-shaped section continues in the front-rear direction, since the top part P1 comes out of proximity with the protrusion 101*a* of the lower die 101 after the press working because of spring back and the like, the hardness of the substantially middle part of the top part P1 in the right-left direction may particularly be insufficient.

Figure 2:
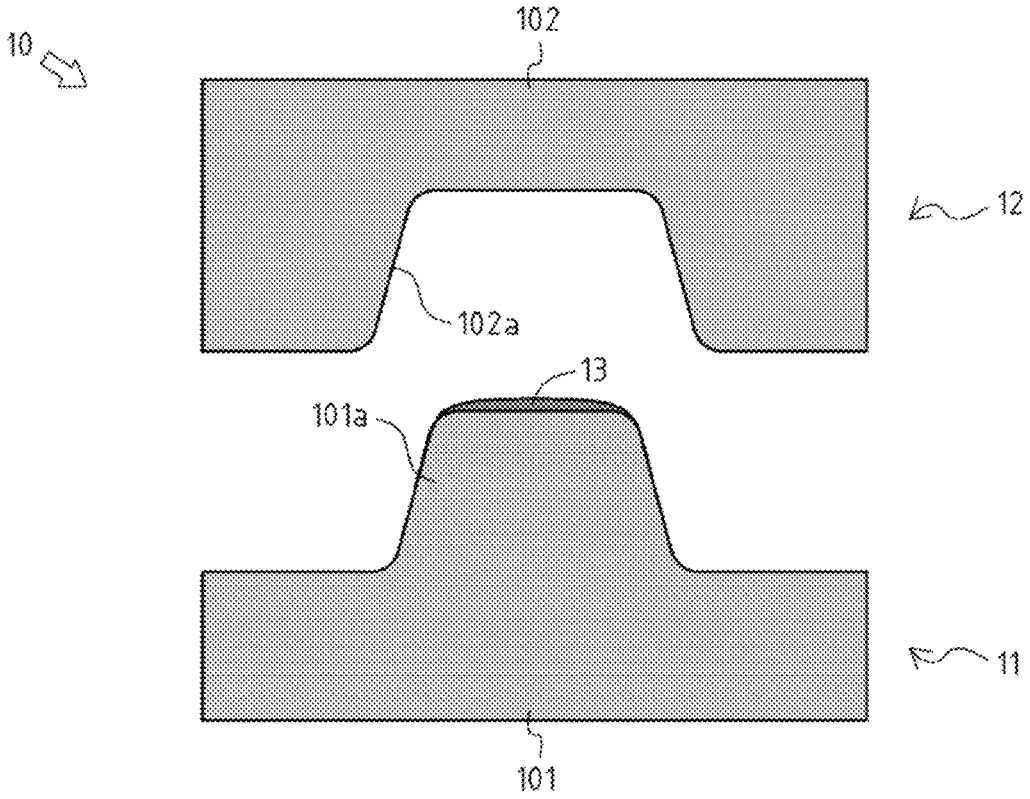
FIG. 2 illustrates a hot-pressing die according to another embodiment.

Therefore, as shown in FIG. 2, the die 10 can be configured so that one buildup part 13 to fill one lower gap situated between the top part P1 and the protrusion 101*a* is formed.

Specifically, since the top part P1 of the product P, after being pressed, forms a convex shape to gradually change in position upward from the connections between the top part P1 and the lateral parts P2 to the middle of the product P in the right-left direction, one buildup part 13 is formed on the forming surface (the surface corresponding to the top part P1) of the protruding end (uppermost part) of the protrusion 101*a* so that the convex shape is a final shape (a shape in which spring back and the like after the press working are not taken into consideration) of the top part P1. In other words, the lower die 101 is modified into the modified lower die 11 by forming, on the forming surface of the protruding end (uppermost part) of the protrusion 101*a*, the buildup part 13 with the convex shape to gradually change in position in the Protruding direction (top direction) of the protrusion 101*a* toward the middle, in the right-left direction, of the forming surface of the protruding end (uppermost part) of the protrusion 101*a* along the shape of the top part P1 of the product P deformed after being pressed.

Therefore, the top part P1 of the product P can be cooled at a sufficient cooling rate, thus enabling to prevent the hardness of the substantially middle part of the top part P1 in the right-left direction from being smaller than a predetermined value. In this manner, to prevent the hardness of the substantially middle part, whose hardness ma particularly be insufficient, of the top part P1 in the right-left direction allows the whole product P to have sufficient hardness.

Figure 3:
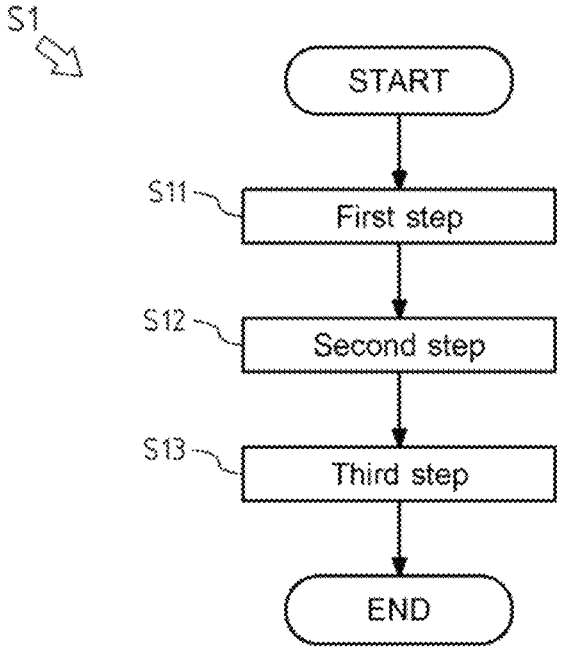
FIG. 3 is a flowchart showing a step for manufacturing the hot-pressing die according to an embodiment of the present invention.
Figure 4:
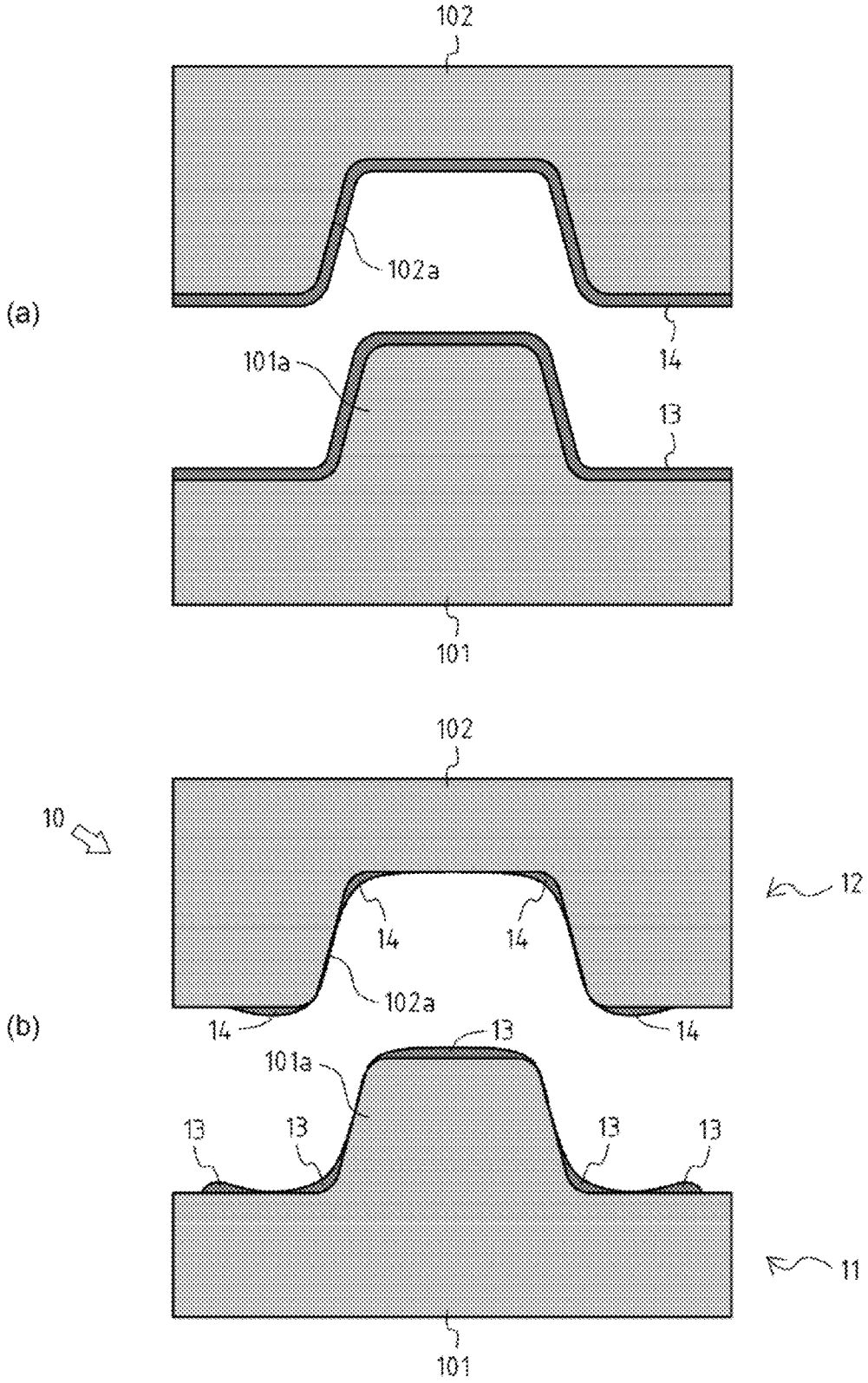
FIG. 4 shows a step for modifying a hot-pressing die, in which FIG. 4(*a*) illustrates the hot-pressing die with a forming surface to which overlay welding is performed, and FIG. 4(*b*) illustrates the hot-pressing die with a forming surface on which a plurality of buildup parts are formed.

With reference to FIGS. 3 and 4, described below is a step S1 for manufacturing the die 10 as an embodiment of as method for manufacturing a hot-pressing die according to the present invention.

The step S1 is as step for manufacturing the die 10 out of the die 100 as a conventional hot-pressing die.

As shown in FIG. 3, the step S1 includes a first step S11, a second step S12 and a third step S13, and these steps are performed in mentioned order therein.

The first step S11 is a step for measuring a three-dimensional shape of the forming surface of the die 100 as a conventional hot-pressing die, and a three-dimensional shape of the surface of the product P formed by the die 100.

In the first step S11, three-dimensional shapes of the forming surfaces of the lower die 101 and the upper die 102 in the die 100 are measured.

Then, the three-dimensional shape of the product P which is formed by the die 100, namely, which is slightly deformed after being pressed by the die 100 because of spring back and the like, is measured. Specifically, a three-dimensional shape of a surface of the product P facing the lower die 101, and a three-dimensional shape of a surface of the product P facing the upper die 102 are measured.

These measurements may be performed with a contact-type device measuring a shape of an object to be measured by bringing a probe into contact with the object, a noncontact-type device measuring a shape of an object to be measured by irradiating the object with a laser, or the like. The measured three-dimensional shapes, namely, three-dimensional coordinate data are stored in a predetermined storage electrically connected to the device.

In the present embodiment, the shape of the product P formed by the die 100 is measured after the shape of the forming surface of the die 100 is measured, but order of these measurements is not limited thereto.

The second step S12 is a step for calculating, based on the three-dimensional shape of the forming surface of the die 100 as a conventional hot-pressing die, and the three-dimensional shape of the surface of the product P harmed by the die 100 which are measured in the first step S11, three-dimensional shapes of gaps between the forming surface of the die 100 and the surface of the product P when the die 100 is closed (when the upper die 102 is at the bottom dead center).

In the second step S12, based on three-dimensional shape of the forming surface of the lower die 101, and the three-dimensional shape of the surface of the product P facing the lower die 101, three-dimensional shapes (three-dimensional coordinate data) of the lower gaps between these surfaces are calculated. Additionally, based on three-dimensional shape of the forming surface of the upper die 102, and the three-dimensional shape of the surface of the product P facing the upper die 102, three-dimensional shapes (three-dimensional coordinate data) of the upper gaps between these surfaces are calculated.

The calculation of the three-dimensional shapes (three-dimensional coordinate data) of the lower gaps and the upper gaps may be performed with a predetermined arithmetic device electrically connected to the storage in which the three-dimensional shapes (three-dimensional coordinate data), measured in the first step S11, of the forming surfaces of the lower die 101 and the upper die 102, and the surface of the product P are stored.

The arithmetic device matches any two surfaces as three-dimensional coordinate data to each other at a suitable position (a position at which similarity between the two surfaces is the maximum) to calculate difference between the two surfaces, thereby calculating three-dimensional shapes (three-dimensional coordinate data) of gaps between the two surfaces. An existing arithmetic device may be adopted as the arithmetic device. In the present embodiment the arithmetic device calculates the three-dimensional shapes (three-dimensional coordinate data) of the lower gaps and the three-dimensional shapes (three-dimensional coordinate data) of the upper gaps based on the three-dimensional shapes (three-dimensional coordinate data), stored in the storage, of the forming surfaces of the lower die 101 and the upper die 102, and the surface of the product P.

The third step S13 is a step for manufacturing the die 10 by modifying the forming surface of the die 100 based on the three-dimensional shapes, calculated in the second step S12, of the gaps between the forming surface of the die 100 as a conventional hot-pressing die, and the surface of the product P.

In the third step S13, as shown in FIG. 4(*a*), the buildup part 13 is formed on the forming surface of the lower die 101 in a predetermined thickness (length from a surface of the buildup part 13 being in contact with the forming surface of the lower die 101 to an outside surface of the buildup part 13) by performing overlay welding 01 the whole forming surface of the lower die 101, and the buildup part 14 is formed on the forming surface of the upper die 102 in a predetermined thickness (length from a surface of the buildup part 14 being in contact with the forming surface of the upper die 102 to an outside surface of the buildup part 14) by performing overlay welding of the whole forming surface of the upper die 102.

Then, as shown in FIG. 4(*b*), the plurality of buildup parts 13 coinciding in form with the lower gaps are formed by cutting the buildup part 13 formed on the forming surface of the lower die 101 based on the three-dimensional shapes of the lower gaps calculated in the second step S12, and the plurality of buildup parts 14 coinciding in form with the upper gaps are formed by cutting the buildup part 14 formed on the forming surface of the upper die 102 based on the three-dimensional shapes of the upper gaps calculated in the second step S12. Specifically, the plurality of buildup parts 13 coinciding in form with the lower gaps are formed by performing numerical control machining of the buildup part 13 formed on the forming surface of the lower die 101 after applying the three-dimensional coordinate data of the lower gaps to data for the numerical control machining, and the plurality of buildup parts 14 coinciding in form with the upper gaps are formed by performing numerical control machining of the buildup part 14 formed on the forming surface of the upper die 102 after applying the three-dimensional coordinate data of the upper gaps to data for the numerical control machining.

Thus, the modified lower die 11 and the modified upper die 12 are fabricated, the modified lower die 11 having the lower die 101 and the plurality of buildup parts 13 formed on the forming surface of the lower die 101 so as to fill the lower gaps, the modified upper die 12 having the upper die 102 and the plurality of buildup parts 14 formed on the forming surface of the upper die 102 so as to fill the upper gaps.

As mentioned above, in the step S1, passing through the first step S11, the second step S12 and the third step S13 in order, the die 10 having the modified lower die 11 and the modified upper die 12 is manufactured.

In the step S1, the three-dimensional shape of the forming surface of the die 100 as a conventional hot-pressing die, and the three-dimensional shape of the surface, of the product P formed by the die 100 are measured, and then the die 10 is manufactured so that the product P defamed slightly after being pressed by the die 100 because of spring back and the like coincides in form with the space between the forming surfaces of the modified lower die 11 and the modified upper die 12 positioned at the bottom dead center.

In other words, the die 10 is manufactured in consideration of the deformation of the product P after being pressed by the die 100 as a conventional hot-pressing die.

Therefore, even the product P pressed by the die 10 deforms because of spring back and the like, but, compared with the product P pressed by the die 100 as a conventional hot-pressing die, an influence of spring back and the like occurring in the product P is controlled to a minimum, and deformation amount of the product P is reduced.

Consequently, during the quenching, a contact area between the product P and the die 10 can be increased, and the product P can suitably be cooled.

In the present embodiment, the die 10 is manufactured by forming the plurality of buildup parts 13 and the plurality of buildup parts 14 on the forming surface of the lower die 101 and the forming surface of the upper die 102 respectively, namely, by performing overlay welding of the forming surface of the die 100 as a conventional hot-pressing die. However, the die 10 may be manufactured by cutting the forming surface of the die 100, or by performing overlay welding, and cutting of the forming surface of the die 100.

Moreover, the die 10 may be manufactured out of a predetermined ingot.

Figure 5:
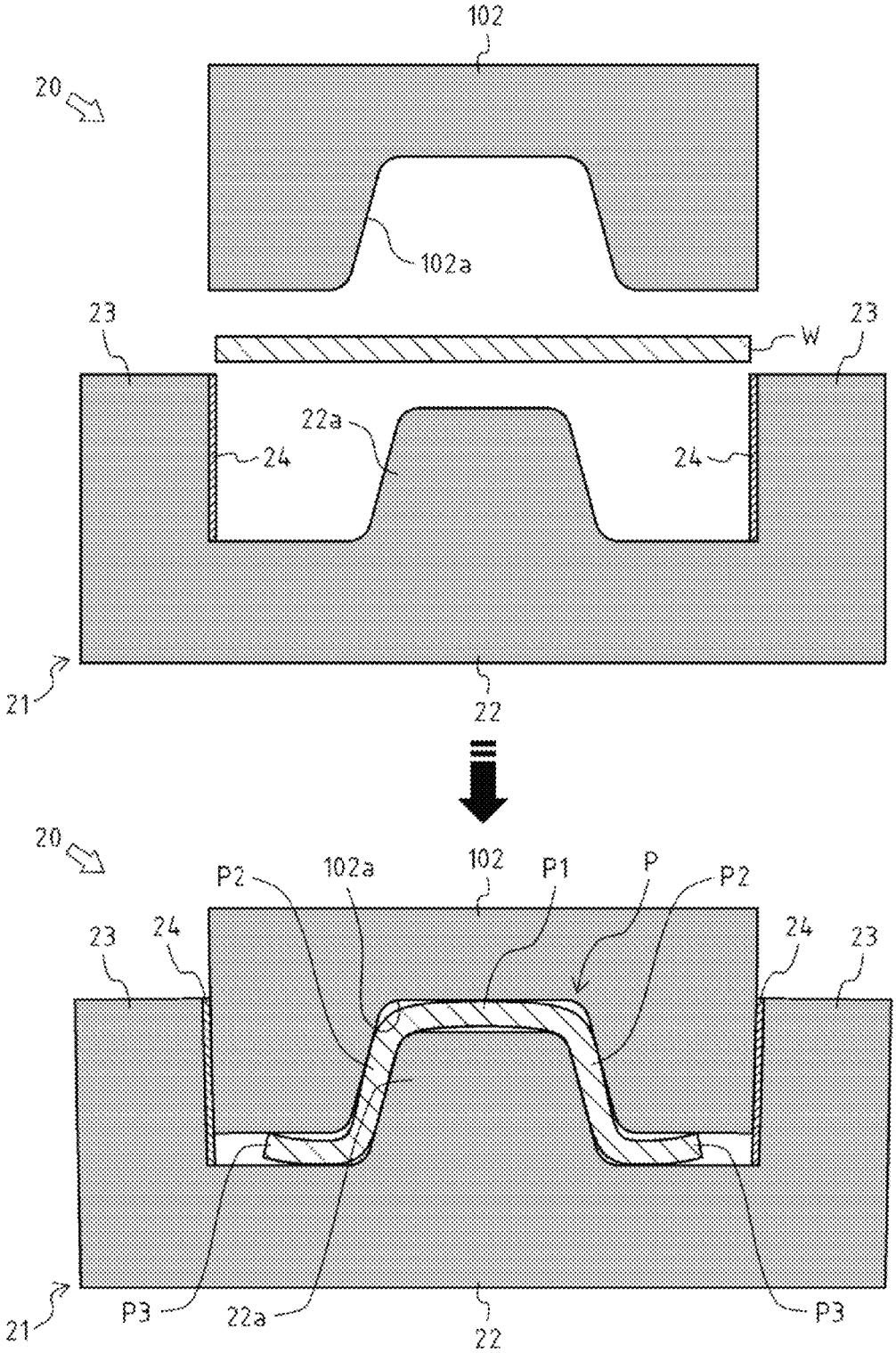
FIG. 5 illustrates a hot-pressing die according to another embodiment.

With reference to FIG. 5, described below is a die 20 as another embodiment of a hot-pressing die.

The die 20 is a hot-pressing die. The die 20 is fixed to a predetermined pressing machine (not shown), and performs the hot-press forming of the workpiece W to produce the product P.

For convenience, a top-bottom direction in FIG. 5 is defined as a top-bottom direction of the die 20, and a right-left direction in FIG. 5 is defined as a right-left direction of the die 20. In addition, this side in FIG. 5 is defined as a front side of the die 20, and the far side in FIG. 5 is defined as a rear side of the die 20, thereby a front-rear direction of the die 20 being defined.

As shown in FIG. 5, the die 20 includes a modified lower die 21 and the upper die 102 which are arranged so that the forming surfaces thereof are opposed to each other.

The modified lower die 21 has a working part 22, a pair of backup parts 23, and a pair of shims 24.

The working part 22 corresponds to the upper die 102, and is substantially similar in configuration to the lower die 101 (see FIG. 7) of the die 100 as a conventional hot-pressing die. The working pan 22 has a protrusion 22*a* which protrudes upward along the shape of the recess 102*a* of the upper the 102 from the intermediate part (the substantially middle part), in the right-left direction, of the forming surface the upper surface) thereof.

The protrusion 22*a* forms, with the recess 102*a* of the upper die 102, the top part P1 and the lateral parts P2 of the product P. The protrusion 22*a* is substantially similar in configuration to the protrusion 101*a* of the lower die 101. The surface of the protrusion 22*a* corresponding to the top part P1 substantially horizontally extends in the right-left direction, and the two surfaces of the protrusion 22*a* corresponding to the lateral parts P2 are inclined to gradually separate from each other toward the bottom ends thereof.

The backup parts 23 are configured to sandwich the upper die 102 positioned at the bottom dead center therebetween in the right-left direction. The backup parts 23 control deformation (flexure) of the upper the 102 to a minimum when the workpiece W is pressed.

Specifically, the backup parts 23 are formed integrally with the working part 22 at respective each of the working part 22 in the right-left direction, and protrude upward above the forming surface of the modified lower die 21. The inner surfaces (the surfaces facing the upper die 102 positioned at the bottom dead center) of the backup parts 23 correspond to the outer surfaces of the upper die 102 in the right-left direction, and come in contact with the outer surfaces of the upper die 102 in the right-left direction.

The backup parts 23 configured as mentioned above control deformation of the upper die 102 to a minimum by applying a force in opposite direction of the deformation to the upper die 102 which deforms so that the parts of the upper die 102 other than the recess 102*a* move away from each other when the workpiece W is pressed. The deformation of the upper die 102 is controlled to as minimum, thus enabling to suitably press the workpiece W, and to control at reduction of a contact area between the product P and the die 20 to a minimum during the quenching.

The shims 24 are plates each having a predetermined thickness (dimension in the right-left direction). The shims 24 are fixed to the inner surfaces (the surfaces facing the upper die 102) of the backup parts 23 so as to intervene between the backup parts 23 and the upper die 102 when the workpiece W is pressed.

During the press working of the workpiece W, since deformation of the upper die 102 cause the backup parts 23 to deform to slightly move is from each other, it is difficult for the backup parts 23 to completely prevent the upper die 102 from deforming.

However, if the shims 24 are fixed to the inner surfaces (the surfaces facing the upper die 102) of the backup parts 23 so as to intervene between the inner surfaces of the backup parts 23 and the outer surfaces of the upper die 102 in the right-left direction when the workpiece W is pressed, the length between the backup pans 23 is reduced by the thicknesses of the shims 24, and an increased force is applied, in opposite direction of the deformation, to the upper die 102 which deforms so that the parts of the upper die 102 other than the recess 102*a* move away from each other.

This makes it possible to further restrain the parts of the upper die 102 other than the recess 102*a* from moving away from each other, and to suitably press the workpiece W.

Therefore, a contact area between the product P and the die 20 can be increased without increasing a pressure at which the workpiece W is pressed, and the product P can suitably be cooled during the quenching.

Note that there is no space between the inner surfaces (the surfaces facing the upper die 102) of the backup parts 23 and the outer surfaces, in the right-left direction, of the upper die 102 positioned at the bottom dead center, but shims each having, an extremely small thickness (dimension in the right-left direction) can be inserted between them since the backup parts 23 and the upper die 102 slightly deform as mentioned previously.

Figure 6:
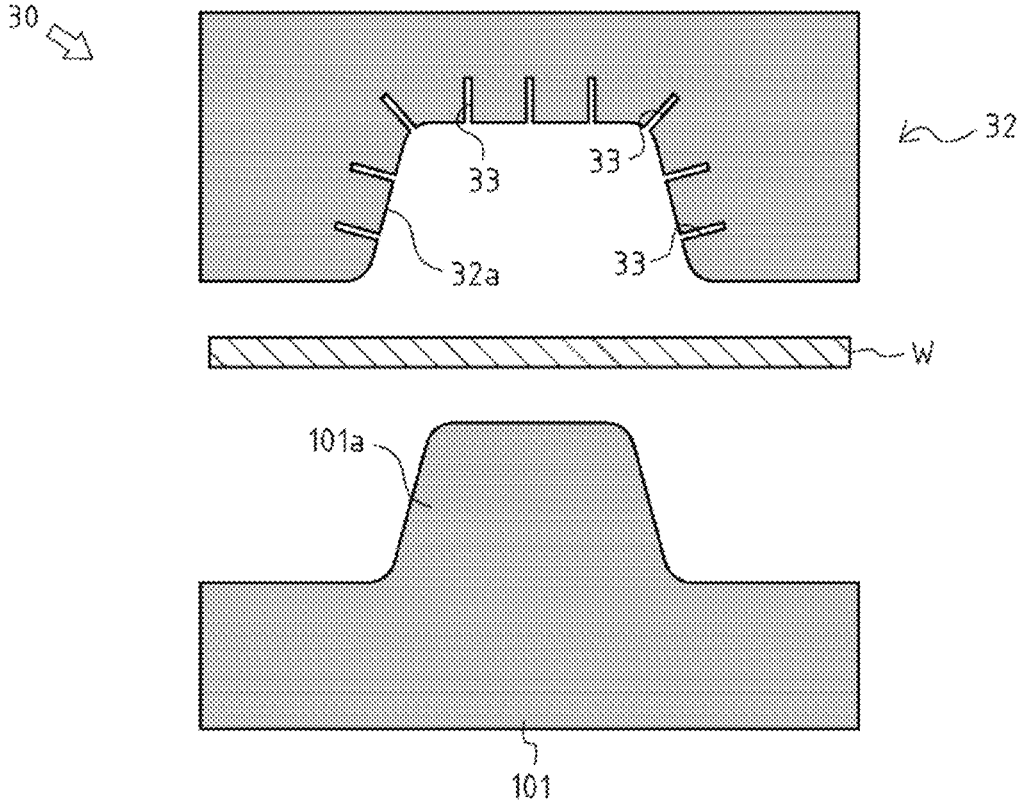
FIG. 6 illustrates a hot-pressing die according to another embodiment.

With reference to FIG. 6, described below is a die 30 as another embodiment of a hot-pressing die.

The die 30 is a hot-pressing die. The die 30 is fixed to a predetermined pressing machine (not shown), and performs the hot-press conning of the workpiece W to produce the product P.

For convenience, a top-bottom direction in FIG. 6 is defined as a top-bottom direction of the die 30, and a right-left direction in FIG. 6 is defined as a right-left direction of the die 30. In addition, this side in FIG. 6 is defined as a front side of the die 30, and the far side in FIG. 6 is defined, as a rear side of the die 30, thereby a front-rear direction of the die 30 being defined.

As shown in FIG. 6, the die 30 includes the lower die 101 and a modified upper die 32 which are arranged so that the forming surfaces thereof are opposed to each other.

The modified upper die 32 is substantially similar in configuration to the upper die 102 (see FIG. 7) of the die 100 as a conventional hot-pressing die, and has a plurality of slits 33 formed on the forming surface (the lower surface) of the modified upper die 32. In other words, the modified upper die 32 differs from the upper die 102 in having the plurality of slits 33. Moreover, the modified upper die 32 has a recess 32*a* in which the intermediate part (the substantially middle part), in the right-left direction, of the forming surface thereof dents upward along the shape of the protrusion 101*a* of the lower die 101.

The recess 32*a* forms, with the protrusion 101*a* of the lower die 101, the top part P1 and the lateral parts P2 of the product P. The surface of the recess 32*a* corresponding to the top part P1 substantially horizontally extends in the right-left direction, and the two surfaces of the recess 32*a* corresponding to the lateral parts P2 are inclined to gradually separate from each other toward the bottom ends thereof.

The slit 33 is formed inward from the forming surface of the recess 32*a* of the modified upper die 32, and is continuously formed throughout the area a the recess 32*a* in the front-rear direction. The slit 33 is formed substantially perpendicularly to a part of the forming surface on which the slit 33 is formed. The plurality of slits 33 are formed on the forming surface of the recess 32*a*, and are arranged at predetermined intervals.

As mentioned above, the plurality of slits 33 are formed to divide the forming surface of the recess 32*a* into a plurality of parts in the front-rear direction.

This makes it possible to bend the modified upper die 32, further than the upper die 102, so that the parts of the modified upper die 32 other than the recess 32*a* move away from each other when the workpiece W is pressed, and to transform the forming surface of the modified upper die 32 along the shape of the product P to efficiently bring the forming surface of the modified upper die 32 into contact with the surface of the product P.

Therefore, a contact aria between the product P and the die 30 can be increased without increasing a pressure at which the workpiece W is pressed, and the product P can suitably be cooled during the quenching.

In the present embodiment, the plurality of slits 33 are formed only on the forming surface of the recess 32*a*. However, in addition to this, the plurality of slits 33 may be formed on the outer surfaces of the upper die 102 in the right-left direction.

In each embodiment as mentioned above, a protrusion (e.g. the protrusion 101*a*) is formed in a lower die (e.g. the lower die 101), and a recess (e.g. the recess 102*a*) is formed in an upper die (e.g. the upper die 102). However, the recess may be formed in the lower die, and the protrusion may be formed in the upper die.

INDUSTRIAL APPLICABILITY

The present invention is applied to a hot-pressing die which presses and cools a heated workpiece at the same time, and to a method for manufacturing the hot-pressing die.

REFERENCE SIGNS LIST

10: die
11: modified lower die
12: modified upper die
13: buildup part
14: buildup part
20: die
21: modified lower die
22: working part
23: backup part
24: shim
30: die
32: modified upper die
33: slit
100: die
101: lower clip
101*a*: protrusion
102: upper die
102*a*: recess
W: workpiece
P: product

The invention claimed is:

1. A hot-pressing die which presses and cools a heated workpiece at the same time to form a product, the hot-pressing die comprising:

a lower die having a right end, a left end and a lower forming surface; and an upper die having a right end, a left end and an upper forming surface facing the lower forming surface, wherein one of the lower die and the upper die has a protrusion that protrudes toward the other of the lower die and the upper die, the protrusion being formed in an intermediate part in a right-left direction of the one of the lower die and the upper die, the other of the lower die and the upper die has a recess, the recess corresponding to the protrusion, and the protrusion has a section formed at a protruding end thereof for forming a top part of the product and extending in the right-left direction, the section being modified to form a convex shape that gradually changes in a protruding direction of the protrusion toward a middle of the section in the right-left direction.

2. A method for manufacturing a hot-pressing die which presses and cools a heated workpiece at the same time to form a product, the method comprising:

measuring a three-dimensional shape of a forming surface of the hot-pressing die, and a three-dimensional shape of a surface of the product formed by the hot-pressing die;

calculating, based on the three-dimensional shape of the hot-pressing die and the three-dimensional shape of the surface of the product measured, a three-dimensional shape of a gap between the forming surface of the hot-pressing die and the surface of the product when the hot-pressing die is closed after the press working; and modifying, based on the three-dimensional shape of the gap calculated, the forming surface of the hot-pressing die so as to fill the gap.

* * * * *